US008741023B2

(12) United States Patent
Hilshorst et al.

(10) Patent No.: US 8,741,023 B2
(45) Date of Patent: Jun. 3, 2014

(54) ORE BENEFICIATION

(75) Inventors: Howard W. Hilshorst, Britt, MN (US); Gregory D. Lindahl, Hibbing, MN (US); James A. Hecimovich, Mountain Iron, MN (US)

(73) Assignee: Superior Mineral Resources LLC, Hibbing, MN (US)

( * ) Notice: Subject to any disclaimer, the term of this patent is extended or adjusted under 35 U.S.C. 154(b) by 40 days.

(21) Appl. No.: 13/560,143

(22) Filed: Jul. 27, 2012

(65) Prior Publication Data

US 2013/0032004 A1 Feb. 7, 2013

Related U.S. Application Data

(63) Continuation-in-part of application No. 13/195,430, filed on Aug. 1, 2011, now Pat. No. 8,545,594.

(51) Int. Cl.

| | |
|---|---|
| ***C22B 4/00*** | (2006.01) |
| ***C22B 1/00*** | (2006.01) |
| ***B03C 1/30*** | (2006.01) |

(52) U.S. Cl.

USPC ..... 75/10.67; 209/39; 241/24.14; 241/24.25

(58) Field of Classification Search

USPC ..... 75/10.67; 209/39; 241/24.14, 24.25

See application file for complete search history.

(56) References Cited

U.S. PATENT DOCUMENTS

| | | | | |
|---|---|---|---|---|
| 3,022,956 | A | | 2/1962 | Haseman |
| 3,086,718 | A | | 4/1963 | Lukas, Jr. |
| 3,502,271 | A | | 3/1970 | Hays |
| 3,672,579 | A | | 6/1972 | Lawver |
| 3,811,623 | A | | 5/1974 | Speer |
| 4,191,655 | A | * | 3/1980 | Quinn et al. ..... 252/60 |
| 4,206,878 | A | | 6/1980 | Forciea |
| 4,512,879 | A | | 4/1985 | Attia |
| 4,778,594 | A | | 10/1988 | Doctor |
| 5,407,080 | A | * | 4/1995 | Welch et al. ..... 209/166 |
| 5,466,574 | A | | 11/1995 | Liberti et al. |
| 5,625,070 | A | | 4/1997 | Rolf et al. |

(Continued)

FOREIGN PATENT DOCUMENTS

| | | |
|---|---|---|
| CN | 101487081 A | 3/2009 |
| DE | 19746852 | 10/1997 |

(Continued)

OTHER PUBLICATIONS

Machine translation of KR 1989-0006300 by Kim, Su-Jin published Jun. 12, 1989.*

(Continued)

*Primary Examiner* — George Wyszomierski
*Assistant Examiner* — Tima M McGuthry Banks
(74) *Attorney, Agent, or Firm* — Nikolai & Mersereau, P.A.; C. G. Mersereau

(57) ABSTRACT

A method of enriching the iron content of low-grade iron-bearing ore materials has been developed which produces a high iron ore concentrate suitable for processing into pig iron and steel. The process includes reducing the low-grade iron-bearing ore materials to a fine particulate form and treating a water slurry of this material by applying a combination of ultrasonic treatments in a plurality of high and low intensity magnetic separation operations to remove interfering materials and concentrate magnetic and paramagnetic iron-bearing materials into a high-grade ore stock.

37 Claims, 3 Drawing Sheets

(56) References Cited

U.S. PATENT DOCUMENTS

| | | | |
|---|---|---|---|
| 5,868,255 | A | 2/1999 | McGaa |
| 5,961,055 | A | 10/1999 | Lehtinen |
| 6,269,952 | B1 | 8/2001 | Watt et al. |
| 6,277,168 | B1 | 8/2001 | Huang et al. |
| 6,383,397 | B1 | 5/2002 | Kojima |
| 7,360,657 | B2 | 4/2008 | Oder et al. |
| 7,810,746 | B2 | 10/2010 | Gillis et al. |
| 7,938,969 | B2 | 5/2011 | Colvin et al. |
| 8,091,807 | B2 | 1/2012 | Kerns |
| 2002/0157992 | A1 | 10/2002 | McGaa |
| 2009/0250408 | A1 | 10/2009 | Xie et al. |
| 2010/0263482 | A1 | 10/2010 | Liubakka et al. |
| 2010/0264136 | A1 | 10/2010 | Liubakka et al. |
| 2010/0264241 | A1 | 10/2010 | Liubakka et al. |
| 2011/0162956 | A1 | 7/2011 | Danov et al. |

FOREIGN PATENT DOCUMENTS

| | | |
|---|---|---|
| JP | 2003-181494 | 12/2001 |
| JP | 2005125249 | 5/2005 |
| KR | 1019900008927 | 12/1990 |
| WO | WO2006/129262 | 12/2006 |
| WO | WO2006129262 A | 12/2006 |
| WO | WO2007/108984 | 9/2007 |
| WO | WO2008/051356 | 5/2008 |
| WO | WO2010/031681 | 3/2010 |

OTHER PUBLICATIONS

Lawyer & Carpenter, Mining Engineers, *WET Magnetic Separation of Oxidized Semitaconites*, Sep. 1965, pp. 87-91.

Palasvirta, Mining Engineering, *High-Intensity Magnetic Spearation of Iron Ores*, Dec. 1959, pp. 1244-1248.

Norrgran & Marin, Minerals and Metallurgical Processing, *Rare Earth Permanent Magnet Separators and Their Applications in Mineral Processing*, Feb. 1994, pp. 41-45.

W.J.D. Stone (President), A.J. Kennedy (Development Manager), Ferro-Magentics Ltd., *Commercial Application of High Intensity Wet Magentic Separation for Iron Ore*, Feb. 28-Mar. 4, 1971, pp. 1-25.

Ande'n et al, Society of Mining Engineers of Aime, *Beneficiation of a Swedish Iron Ore Tailings With a Sala-High Gradient Magentic Separator*, Feb. 24-28, 1980, Preprint No. 80-75, pp. 1-16.

Arol and Iwasaki, Minerals and Metallurgical Processing, *Control of Montmorillonite Via Complexation and Ultrasonics in the Selective Flocculation of Iron Ores*, May 1987, pp. 82-87.

Notification of Transmittal of the International Search Report and the Written Opinion of the International Searching Authority, or the Declaration Mailed Feb. 15, 2013.

* cited by examiner

Conceptual Flowsheet Showing Tailings Disposal & Process Water Recovery

ORE BENEFICIATION

CROSS-REFERENCED TO RELATED APPLICATIONS

This application is a continuation-in-part of application Ser. No. 13/195,430, filed Aug. 1, 2011, and that application is deemed incorporated herein by reference in its entirety.

STATEMENT REGARDING FEDERALLY SPONSORED RESEARCH OR DEVELOPMENT

Not applicable

BACKGROUND OF THE INVENTION

I. Field of the Invention

The present invention relates generally to the processing of iron-bearing ore materials and, particularly, to a process for enriching the usable iron ore content of low-grade, iron-bearing feed materials such as are found in tailings piles and which heretofore have not been commercially usable.

II. Related Art

Throughout northeastern Minnesota and other iron mining regions of the world, there exists extensive stockpiles of commercially unusable, low-grade iron ore including large rocks that were rejected as tailings during the active ore removal mining phase because they lacked sufficient quantities of key mineral ores having sufficient iron content to justify further commercial processing. These significant volumes of low-grade ores typically contain less than 34% iron and may contain high concentrations of unusable forms of iron and silica-bearing or clay materials which has rendered these wastes ore deposits as not fit for further processing into taconite pellets or high-grade ore for producing pig iron.

Specifically, the material contained in these large, non-commercial ore stockpiles contains several mineral forms of iron ores, including magnetite ($Fe_3O_4$), hematite ($Fe_2O_3$), goethite (FeO.OH), siderite ($FeCO_3$) and limonite ($FeO.OH.nH_2O$). All of these forms would be desirable as a concentrate, with the exception of limonite, which has a high quantity of attached water of hydration as an undesirable factor. Also present is a large amount of gangue material which includes several silts and clay materials, namely, chamosite, stilpnomalanene and kaolin. These small clay particles, also known as slimes, contain silica contaminates that are difficult to remove from the mix due to their strong adhesion properties. The clay particles are very small (<5 microns) and have a propensity to coat particles of iron-bearing materials making the extraction and concentration of those materials very difficult.

It is known to use ultrasonic techniques to dislodge gangue particles from iron ores. Various techniques have been employed and an example of this is found in U.S. Pat. Pub. 2010/0264241 A1, which uses an ultrasonic crusher pipe system to separate gangue from ore in a waterborne slurry. Magnetic separators have also been employed to enrich magnetic ore concentrations in a feed material, as shown in U.S. Pat. No. 5,868,255 to McGaa. Although such techniques have been employed with some degree of success, no practical process has heretofore been developed to economically enrich low-grade ores.

It would present a distinct advantage if an overall complete process could be developed whereby non-commercial low-grade iron-bearing materials of various compositions, presently considered waste material, could be processed into a concentrate containing a much higher percentage of iron that can be cost effectively converted into metallic iron and steel.

SUMMARY OF THE INVENTION

In accordance with the present invention, a method of enriching the iron content of low-grade iron-bearing ore materials has been developed which produces an ore concentrate having a high iron content suitable for processing into pig iron and steel. The process includes reducing the low-grade iron-bearing ore materials to a fine particulate form and treating a water slurry of this particulate material to a further process employing a combination of ultrasonic treatments and a plurality of high and low intensity magnetic separation operations to remove interfering materials and concentrate magnetic and paramagnetic iron-bearing materials into a high-grade ore stock.

As used herein, the term "paramagnetic" refers to materials not normally magnetic themselves, but which may react and align when placed in a sufficiently strong magnetic field. These include hematite ($Fe_2O_3$), goethite (FeO.OH) and siderite ($FeCO_3$) materials, which may be present in the feed material.

In a preferred embodiment, the process includes forming a water slurry of low-grade iron-bearing feedstock materials which have been reduced to a relatively small particle size by subjecting the low-grade iron-bearing material to crushing and ball mill grinding operations. A preferred particle size is at least −325 mesh and preferably −400 to −500 mesh. The slurry is subjected to a screening step to confirm particulate size and thereafter is subjected to an ultrasonic treatment that is sufficient to dislodge and separate gangue including clays and interfering materials from the iron containing particles. The ultrasonically treated material is then subjected to a plurality of relatively low, intensity magnetic separation steps to concentrate the higher magnetic ore fraction (magnetite) with the slurry containing the separated gangue materials and the paramagnetic ore materials being removed for further treatment as a non-magnetic/paramagnetic tail fraction.

In one embodiment, the non-magnetic/paramagnetic tail fraction is subjected to a further ultrasonic step to again separate interfering gangue materials from the ore containing particles. This material is concentrated in a thickener and separated from the overflow slurry water, the heavier iron containing materials remaining in the underflow or bottom fraction. The underflow material is then subjected to a plurality of relatively high field strength magnetic separation stages to separate out other desirable ore fractions.

The first relatively high magnetic separation stage following the first ultrasonic treatment and processing in a thickener, has sufficient field strength to concentrate the hematite fraction and ensuing stages for separating out paramagnetic materials are operated at a higher field strength to separate out siderite and other desirable ore fractions. The concentrated ore fractions are then subjected to further concentration filtering and drying stages where the magnetic and paramagnetic compound fractions can be combined and made available for use.

An alternative embodiment uses additional pre-treatment grinding and screening in the formation of the initial slurry. In addition, in further processing the non-magnetic/paramagnetic tail fraction, it has been found that it may be advantageous to concentrate the material in a thickener and separate it from the overflow slurry water prior to further ultrasonic treatment. Ultrasound is then used to treat the heavier, iron-containing underflow or bottom fraction material. After ultrasound treatment, the material is subjected to a plurality of high gradient magnetic separation treatments to remove the paramagnetic materials which are combined with the magnetic materials.

A wide variety of feed material compositions can be successfully processed. The final product is in the form of a loose, processed material having a moisture content of from 0-10% and an iron content of from 40%-62% total iron and 7-9% silica. The concentrate may be further processed into briquettes, pellets or balls, if desired, with various additives using a variety of binders and agglomerating technologies.

The process water can be recycled using cyclone separation and clarifying steps to separate the solid final tailings so that the process actually requires a minimum of makeup water. The solid tailings can be separately stored.

DETAILED DESCRIPTION

The following detailed description illustrates one or more specific embodiments by which the invention may be practiced. The description is intended to present the process by way of example and is not intended to limit the scope of the inventive concepts.

The present invention is directed to a comprehensive process for enriching low-grade iron-bearing ore materials that have heretofore been found to be unusable and have generally been disposed of in low-grate or reserve stockpiles, tailing basins, or the like. The present process makes the use of these materials economically feasible for the production of iron and steel. As indicated, the low-grade iron-bearing materials may stem from a variety of sources and include various fractions of a wide variety of desirable iron compounds and interfering materials. The low-grade material may also contain large amounts of undesirable or unusable forms of iron which are not easily processed into metal. Interfering materials or gangue may include fine particulate silica bearing or other clay materials, which tend to cling to the particulate iron compounds tenaciously.

The present process enriches the low-grade iron-bearing materials by concentrating desirable constituents including magnetite ($Fe_3O_4$), hematite ($Fe_2O_3$), goethite (FeO.OH) and possibly siderite ($FeCO_3$). Magnetite and hematite are the main desired iron ore compounds.

The low-grade iron-bearing material is the feed material or feedstock for the present process. In this regard, it will be appreciated that the relative amounts of the desirable constituents may vary widely among feed materials, particularly, the relative amounts of hematite ($Fe_2O_3$) and magnetite ($Fe_3O_4$) may vary widely. An important aspect of the present process is that it adapts successfully to a wide variety of feed material compositions.

Figure 1:
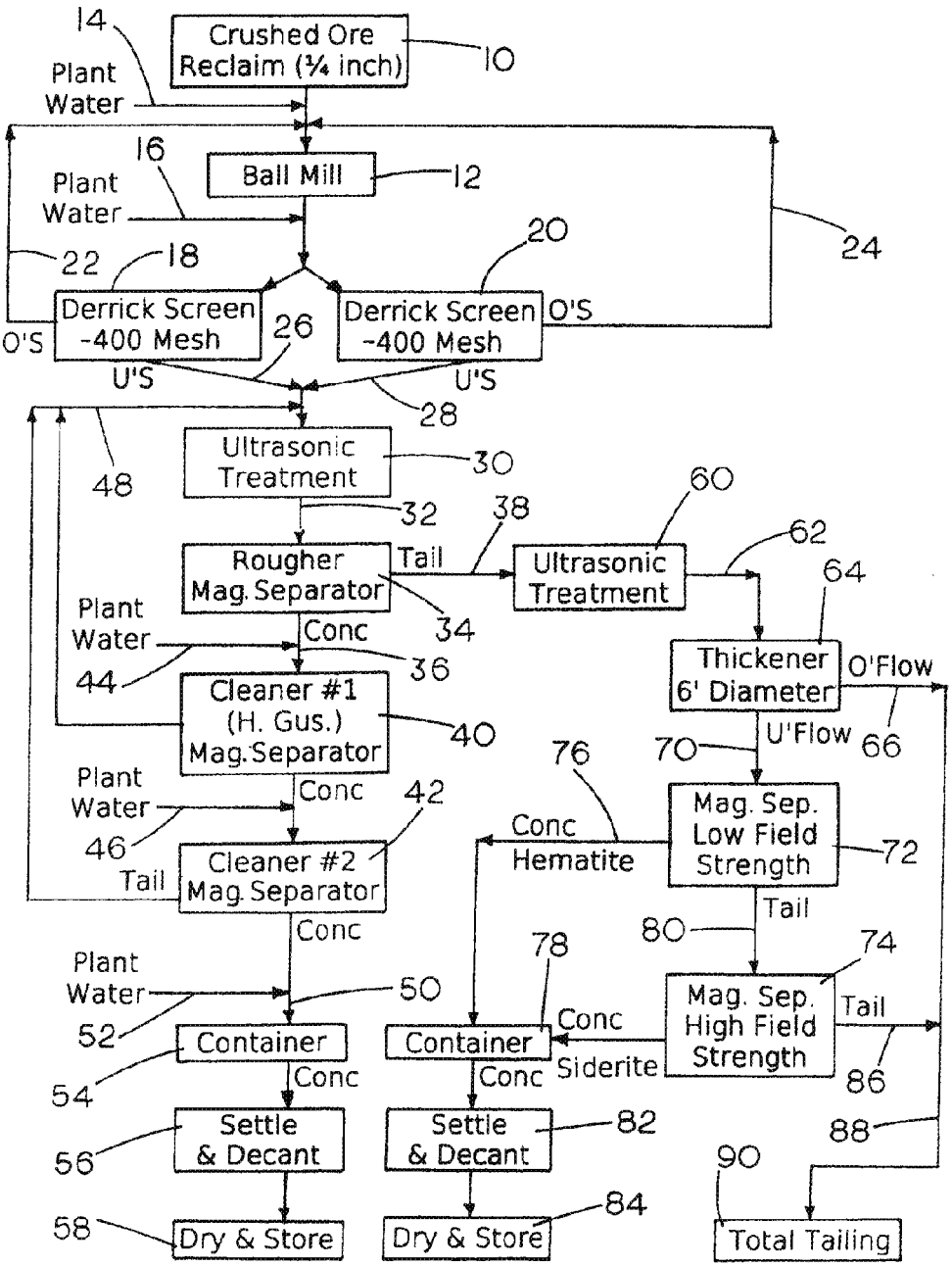
FIG. 1 is a schematic flow diagram illustrating an embodiment of the process of the invention.

In the process, low-grade iron-bearing materials are obtained, generally from discarded stockpiles, and fed into a conventional ore crushing mill, as shown at 10 in FIG. 1. This step is designed to crush the material to a size of ¾ inch (1.9 cm), or less, and preferably the material is reduced to a size of ¼ inch (0.64 cm), or less.

The crushed feed material is next fed into a commercially available ball mill at 12, along with an amount of water at 14, where it is further reduced to a size of about −300 to −500 mesh, and preferable to at least −400 mesh. Such ball mills are commercially available in various sizes and capacities, and one such mill is a Vertimill® obtainable from Metso Corporation of Finland. Upon leaving the ball mill, the material may be mixed with additional water at 16 to form a slurry which is subjected to screening at 18 and 20 with the oversize particulates being recycled to the ball mill at 22 and 24. The sizing screens are preferable vibrating screen devices, which are well known. Such screens are available in various capacities from Derrick Corporation of Buffalo, NY, for example.

Material passing the screens proceeds in streams 26 and 28 to undergo ultrasonic treatment at 30 as a slurry of approximately −400 mesh or less particulate matter in which the ore compound particles are covered with a layer of fine clay particles, or the like. The surface chemistry interactions of the particles creates a complex environment of electrically charged surfaces that cause fine particles of non-iron-bearing materials to adhere to iron-bearing particles in a manner that makes them difficult to separate using conventional physical separation techniques. The fine non-iron-bearing or gangue materials represent a significant fraction of the low-grade ore materials and are chiefly small clay particles (slimes) containing silica contaminates. The clay particles are by nature very small (<5 microns) and need to be separated from the iron-bearing materials in order to allow the material to achieve the desired high iron concentration. Due to the plate-like structure of clay, clay particles can form strong adhesion contact with other flat surfaces. This strong adhesion of clay particles to surfaces, such as iron-bearing ore materials, is difficult to break.

It has been found that the associated turbulence produced by the application of a sufficiently strong ultrasonic treatment can cause the adherence tendency to weaken and allow the materials to separate. The ultrasonic treatment at 30 causes the slurry to undergo such a highly turbulent phase produced by the ultrasonics, as will be explained.

In ultrasonic treatment, as is well known, ultrasonic waves are produced by applying an AC voltage to a crystal such as lead zirconate titanate which undergoes continuous shape changes sending pulsations that travel through the slurry; and, if generated with sufficient amplitude, the pulsations will produce bubbles that grow to a large resonant size and suddenly collapse causing high local pressure changes and a great deal of violent turbulence in the slurry. This type of ultrasonic treatment has been found to be very beneficial in separating silica and clay materials from the iron-bearing compounds in the feed material. The intensity of the ultrasonic turbulence can be controlled as needed to accomplish the desired separation.

In this regard, it has been found that ultrasonic treatment for a selected residence time and using ultrasound having an intensity generally from about 100 watts/gallon of slurry to about 1000 watts/gallon of slurry works well to separate silica and clay fine particles from the iron-bearing particles in the slurry. The residence time and required ultrasound intensity will vary depending on the composition of the slurry being processed.

The material exiting the ultrasonic treatment stage 30 at 32 is a mixture of iron-bearing compound fractions and separated particulates of clay and silica material and other tailing materials. This material generally contains both magnetic and paramagnetic iron ore fractions.

The slurry stream 32 is subjected to a first or rough low intensity wet magnetic separation at 34 using a conventional continuous wet magnetic separator that produces a magnetic field of about 700-1600 gauss. These devices are well known and available commercially in a range of capacities.

The rough magnetic separation further concentrates the magnetic fraction in the slurry at 36 and a separate tail fraction containing paramagnetic materials is diverted at 38. Further magnetic separation is carried out in cleaner separators at 40 and 42 and additional makeup water may be added at 44 and 46. In each of the cleaner magnetic operations, the tail or non-magnetic fraction is recirculated in line 48 to undergo further ultrasonic treatment and rough separation where the paramagnetic and interfering materials are ultimately removed at 38.

It will be appreciated that the magnetic separation sequence represented by 34, 40, 42 may be carried out by any desired number of separators which may be operated at any desired intensity level as needed to produce good separation. This may depend on the relative size of the magnetic fraction in a particular feed stock, which may vary widely. The separation generally involves relatively low intensity magnetic fields between about 700 gauss and 3000 gauss as the magnetic fraction will readily separate under these conditions.

The concentrated magnetic fraction at 50 may have additional water added as at 52. This material is then discharged to a container at 54 and concentrated and thickened and water decanted at 56. Thereafter, it is filtered and the filter cake dried and stored at 58 for shipment separately or in combination with a paramagnetic fraction, as will be explained. The material at 58 is a loose processed material having a solids content of 90-95% and may be balled or compressed into pellets or briquettes using well known binders if necessary.

The primary tail stream 38, which includes the paramagnetic iron ore fraction, along with the interfering materials such as clays, undergoes further treatment in parallel with the magnetic fraction. As shown in the schematic flow diagram of FIG. 1, the tail stream 38 is subjected to a further ultrasonic treatment step at 60, similar to that previously described, to again separate the silica and clay fine particulates from the approximately −400 mesh iron-bearing materials. The outlet stream 62 proceeds to a separation step in the form of a thickener 64 which is essentially a clarifier where the heavier iron-bearing materials settle out. This allows a portion of the lighter non-iron-bearing materials in the slurry including some silica-containing materials and clays to be removed in an overflow stream at 66, which becomes part of the final or total tailing fraction at 88.

The thickened or underflow stream leaving the thickener 64 at 70 is subjected to a further series of magnetic separation operations, as shown at 72 and 74 using a high-gradient magnetic separator such as a SLon vertical ring pulsating high-gradient magnetic separator which utilizes the combination of magnetic force, pulsating fluid and gravity to continuously process fine, weakly magnetic or paramagnetic materials. While these separators are generally classified as high intensity magnetic separators, they can be operated over a range of field strengths. The device of 72 is operated at a relatively low field strength of about 1000-3000 gauss, which is sufficient to separate out the hematite fraction which is conducted at 76 to an intermediate container at 78. The tailing stream 80 is conducted to the second high gradient magnetic separator 74. The magnetic separator 74 is operated using a relatively high field strength of about 7500-12,500 gauss which is strong enough to accomplish the separation of the remaining desirable iron ore fraction which is generally chiefly siderite and goethite.

As with the separation of the magnetic constituents, the two stages of high gradient magnetic separators 72 and 74 represent as many stages as may be necessary to accomplish the desired separation. As with the magnetic fraction, the paramagnetic materials are thereafter concentrated and allowed to settle and the liquid fraction is decanted off at 82. The concentrate is filtered and the filter cake is then allowed to dry at 84 and is in the form of a loose material having a solids content of 90%-95%, which can be processed into pellets or briquettes and/or thereafter be mixed with the magnetic material for further processing into steel.

The tailing fractions 66 and 86 are removed in line 88 and 90 as total tailings. The total tailing fraction is thereafter treated to clarify and separate the water for reuse in the process.

Figure 2:
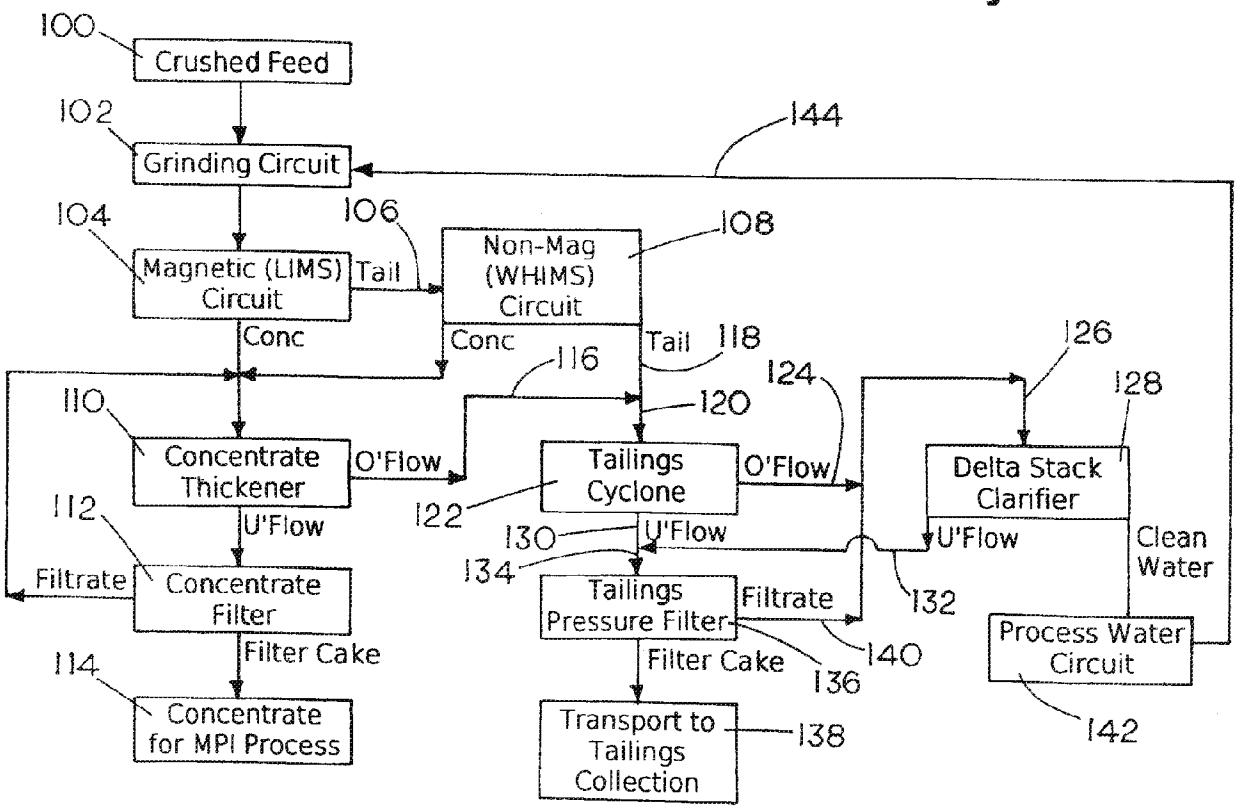
FIG. 2 is a schematic flow diagram illustrating tailings treatment and process water recovery.

The tailings deposit and water recovery aspects of the process are illustrated in the schematic diagram of FIG. 2 in which the supply and crushing operations are represented at 100 and the grinding circuit at 102. The magnetite low intensity magnetic separation circuit, including the several stages, is represented by 104. The tailings fraction from the magnetic separation operation 104 is seen at 106. The paramagnetic high intensity magnetic separation operation circuit is shown at 108. The processed magnetic and paramagnetic concentrate fractions are shown combined for concentration at 110, filtering at 112 and storage at 114. The combined tailings/overflow from the concentration operations is shown at 116, which combines with tail portion 118 to form a total tailings stream at 120. The total tailings fraction is subjected to a cyclone separation operation at 122 and the mainly water overflow stream is shown at 124 where it joins feed stream 126 which proceeds to a clarifier 128. The tailings underflow of bottom discharge stream from the cyclone separator 122 at 130 and the clarifier at 132 are combined at 134 and fed into a tailings pressure filter at 136 where the solid filter cake is collected at 138 for transport to a tailings collection and storage structure and the liquid containing fraction or filtrate material is sent to the clarifier at 140. The clean water from the clarifier proceeds to 142 where it can be recirculated into the process at 144.

Figure 3:
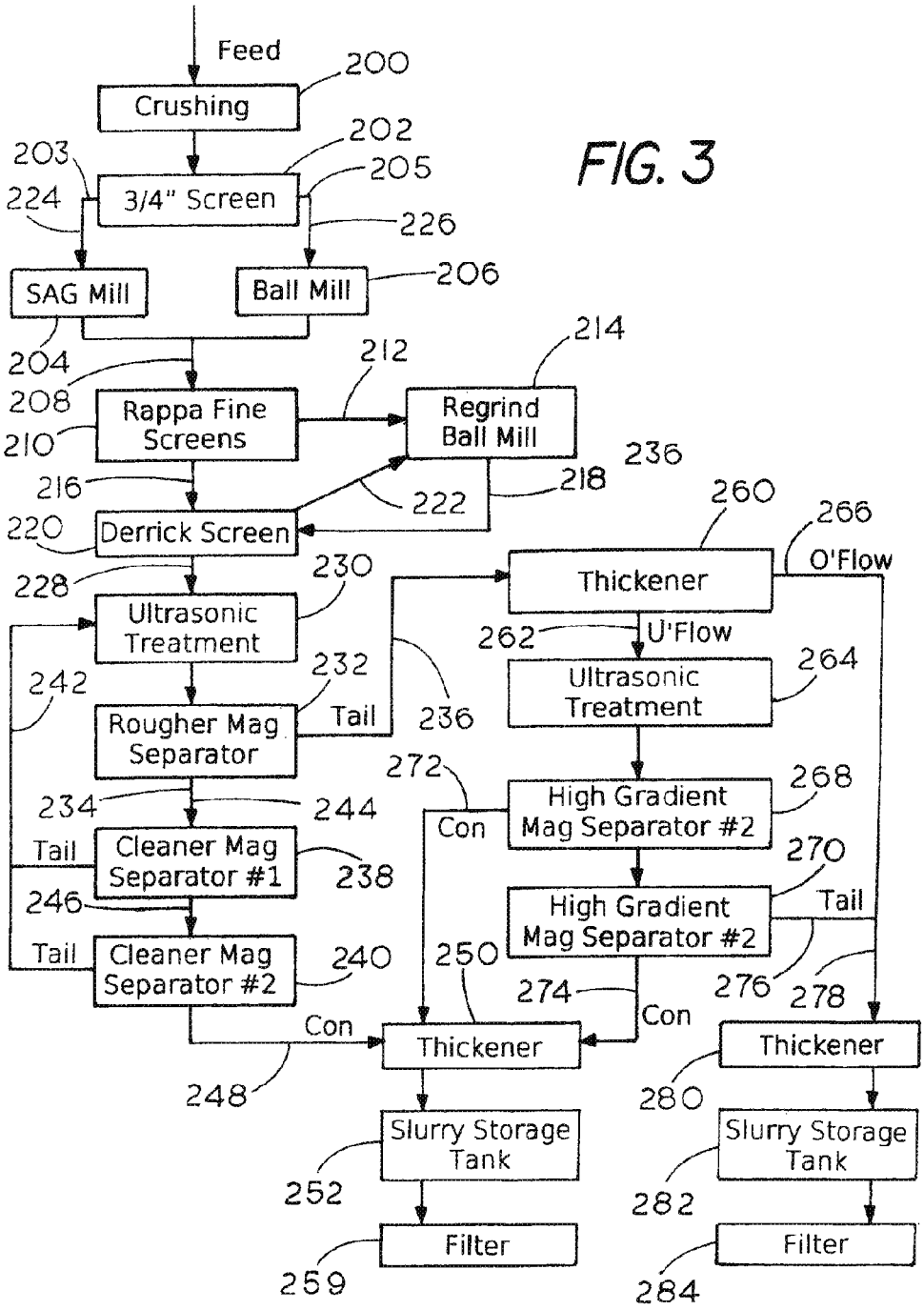
FIG. 3 is a schematic flow diagram of an alternate embodiment of the process of the invention.

A modified or alternate embodiment of the process for enriching the usable iron ore content of low-grade iron-bearing feed materials is depicted in the process flow diagram of FIG. 3. Feed material is crushed in a conventional ore crushing mill at 200, as in the previous embodiment, and fed to the process, preferably as −¾ mesh (−19.1 mm) material, and is passed through a screen at 202. Thereafter, the particle size of the material is further reduced in a Semi-Autogenous Grinding SAG mill at 204 or a ball mill at 206, both of which are well-known and readily available commercially in any desirable capacity. The SAG mill processes the oversize material in stream 203 and the ball mill, the material passed by the screen 202 in stream 205.

The initially screened and ground processed material is recombined at 208 where it is fed to a further finer screening at 210 using a Rapafines or equivalent fine screen device which is preferably about −400 mesh. Oversize material is taken off at 212 and subjected to a further grinding process by a second ball mill at 214. Material passing the fine screen 210 at 216 and material processed by the second ball mill 214 at 218 are subjected to a further screening at 220 as by using a Derrick screen or equivalent which is designed to be −270 to −500 mesh similar to the embodiment first described above. Oversized material is recycled in line 222 to the second ball mill 214.

It will be appreciated that, as with the first embodiment of the process, plant water may be added to form a slurry of desired consistency to the initially screened material at 224 and 226 and additional plant water may be added to any of slurry streams 208, 212, 216, 218 and 220, if desired.

The slurry of undersized material exiting the screen 220 at 228 undergoes a separation sequence as in the first described embodiment including an ultrasonic treatment at 230, which is similar to that described for the first embodiment and is sufficient to separate clay and silica particulates from the iron containing species. The sequence continues with a rough magnetic separation at 232 which again produces a magnetic fraction 234 and a tailing fraction at 236. Further magnetic separation is carried out at 238 and 240 with the combined tail fractions recycled for further ultrasonic treatment in line 242. Additional plant water can be added at 244 and 246.

As indicated, the ultrasonic treatment induces a turbulence in the slurry generally in the form of a micro turbulence that produces a good particulate separation of clay and silica from the ore particles. Residence time and power can be optimized to treat the particular material being processed most efficiently.

Magnetic material exiting the final magnetic separator proceeds in line 248 to a thickener at 250 with the concentrated material being moved to a slurry storage at 252, after which it can be filtered at 254 for further processing as high iron content ore. As with the previously described embodiment, the magnetic separation sequence may be carried out by any desired number of separators operated at any desired intensity level.

In this embodiment, the primary tail stream 236 which includes paramagnetic and non-magnetic fractions also undergoes further processing. However, the tail stream 236 is subjected to the thickening operation at 260 prior to further ultrasonic separation treatment at 264 of the underflow stream 262, which is similar to those described above. The overflow from the thickener goes into a tailing fraction in stream 266. After the ultrasonic treatment at 264, the material is subjected to a series of high gradient or high field strength magnetic separation treatments at 268 and 270 using a field of a strength generally from about 7,500 gauss to about 12,500 gauss with the separated paramagnetic ore fractions taken off at 272 and 274 and the tailing in stream 276. The total tailing stream 278 is processed through a thickener at 280 to a slurry storage tank or the like at 282 before being filtered at 284 and further processed as shown in FIG. 2.

It is important to note that it is the particular combination of ultrasonic and magnetic treatments that enables the iron content of low-grade, commercially unusable ore deposits to be converted into commercially viable feedstocks for iron and steel making processes that contain 40%-62% iron.

Table I shows typical enrichment rates for Roast Taconite (magnetite) and hematite constituents and an average 50-50 mixture.

Samples of the enriched ore material in the form of both nuggets and fine particles have been successfully processed directly into metallic steel (about 1-5% carbon).

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. A method of processing an iron ore feedstock, comprising the steps of:

a) sending pulsations through a slurry comprising iron ore feedstock particles comprising magnetic iron ore material, paramagnetic iron ore material, and gangue material comprising a clay;

b) magnetically separating the pulsed slurry into a concentrated magnetic iron ore fraction and a diverted paramagnetic slurry fraction, wherein the concentrated magnetic fraction comprises concentrated magnetic iron ore material and wherein the paramagnetic slurry fraction comprises paramagnetic iron ore material and gangue material;

c) after the paramagnetic slurry fraction is diverted, using a further magnetic separation to further concentrate the magnetic iron ore material of the magnetic fraction;

d) sending pulsations through the diverted paramagnetic slurry fraction; and e) using a further magnetic separation to further concentrate the paramagnetic iron ore material of the diverted and pulsed paramagnetic slurry fraction.

2. A method of processing an iron ore feedstock, comprising the steps of:

a) sending ultrasonic pulsations through a slurry comprising iron ore feedstock particles to provide ultrasonically treated slurry, said particles comprising magnetic iron ore material, paramagnetic iron ore material, and gangue;

b) magnetically separating ultrasonically treated slurry to provide a diverted tail fraction comprising paramagnetic iron ore material and gangue material;

c) sending ultrasonic pulsations through the diverted tail fraction; and d) using a further magnetic separation to further concentrate the paramagnetic iron ore material of the diverted and ultrasonically treated tail fraction.

3. A method of processing an iron ore feedstock, comprising the steps of:

a) sending ultrasonic pulsations through a slurry comprising iron ore feedstock particles to provide an ultrasonically treated slurry, said particles comprising magnetic iron ore, paramagnetic iron ore, and gangue material;

b) magnetically separating ultrasonically treated slurry into a concentrated magnetic iron ore fraction and a diverted tail fraction comprising paramagnetic iron ore and gangue material;

c) using a further magnetic separation to further separate the concentrated magnetic iron ore fraction from an additional diverted tail fraction comprising paramagnetic iron ore and gangue;

d) optionally using a further magnetic separation to further separate the concentrated magnetic iron ore fraction from an additional diverted tail fraction comprising paramagnetic iron ore and gangue;

(e) drying the concentrated magnetic iron ore fraction; and (f) optionally combining the concentrated magnetic iron ore fraction with a concentrated paramagnetic iron ore fraction obtained from the iron ore feedstock particles.

4. A method of enriching the iron ore content of low-grade iron-bearing feedstock materials to provide a concentrate having a relatively high iron content comprising:

(a) forming a particulate slurry of low-grade iron-bearing feedstock materials comprising magnetic iron ore material, paramagnetic iron ore material and gangue material comprising a clay;

(b) subjecting the slurry of (a) to a first ultrasonic treatment to dislodge and separate the gangue material from the magnetic and paramagnetic iron ore materials;

(c) magnetically separating the slurry of (b) into a magnetic iron ore fraction and a primary tail fraction by subjecting the ultrasonically treated slurry to a plurality of successive stages of magnetic separation to produce a magnetic iron ore concentrate fraction and a primary tail fraction containing paramagnetic iron ore and gangue materials;

(d) thickening the primary tail fraction;

(e) ultrasonically treating the thickened primary tail fraction; and (f) treating the thickened and ultrasonically treated tail fraction to a plurality of successive stages of magnetic separation sufficient to separate a concentrate of paramagnetic ores from the tail fraction.

5. A method as in claim 4 wherein (a) involves the use of a plurality of successively smaller mesh screens.

6. A method as in claim 5 wherein material failing to pass a first screen is ground in a semi-autogenous grinding (SAG) mill and material passing said first screen is ground in a first ball mill.

7. A method as in claim 6 wherein said material as processed in said SAG mill and said first ball mill is subjected to a further screen of about −400 mesh with oversize material being processed in a second or regrind ball mill.

8. A method as in claim 7 further comprising subjecting the material to a third screen of −270 to −500 mesh and recycling oversized material to said second ball mill.

9. A method as in claim 4 including the combining of magnetic and paramagnetic concentrates.

10. A method as in claim 4 wherein said ultrasonic treatments include the generation of micro-turbulence in said slurry.

11. A method as in claim 4 wherein said low-grade iron-bearing feed material comprises one or more of the following ore forms magnetite ($Fe_3O_4$), hematite ($Fe_2O_3$), geothite (FeO.OH), or siderite ($FeCO_3$).

12. A method as in claim 4 wherein in (f) said tail fraction is treated to a plurality of successive stages of magnetic separation of a strength from about 7,500 gauss to about 12,500 gauss.

13. A method as in claim 4 wherein the primary tail fraction of (c) is separated at a first magnetic separator and tail fractions of successive stages of magnetic separation are recycled to (b).

14. A method as in claim 4 wherein said concentrates are further filtered and dried to 90%-95% (weight) solids.

15. A method as in claim 4 wherein said concentrates contain at least 40% (weight) iron.

16. A method as in claim 4 further comprising adding one or more amounts of water to said slurry.

17. A method as in claim 4 further comprising recovering and reusing process water.

18. A method as in claim 4 wherein said ultrasonic treatments include an ultrasonic intensity generally from about 100 watts/gallon to about 1000 watts/gallon for a selected residence time.

19. A method of processing an iron ore feedstock to produce an iron ore concentrate comprising:

(a) providing a slurry comprising a particulate feedstock comprising magnetic iron ore material, paramagnetic iron ore material and gangue material;

(b) ultrasonically treating the slurry of (a);

(c) magnetically separating the ultrasonically treated slurry into a concentrated magnetic iron ore fraction and a primary tail fraction containing a paramagnetic iron ore fraction and gangue material;

(d) thickening the separated primary tail fraction;

(e) ultrasonically treating the separated, thickened primary tail fraction; and (f) magnetically separating a concentrated paramagnetic iron ore fraction from said primary tail fraction.

20. A method as in claim 19 including combining the magnetic and paramagnetic concentrates to form a combined concentrate.

21. A method as in claim 20 wherein the combined concentrate is subjected to further thickening and filtering.

22. A method as in claim 20 wherein said concentrates contain at least 40% (weight) iron.

23. A method as in claim 19 wherein (c) includes a plurality of successive stages of magnetic separation.

24. A method as in claim 19 wherein (f) includes a plurality of successive stages of magnetic separation.

25. A method as in claim 24 wherein a concentrated fraction separated by each stage of magnetic separation is removed separately.

26. A method as in claim 24 wherein said magnetic separation in (f) is a high gradient magnetic separation in the range from about 7,500 gauss to about 12,500 gauss.

27. A method as in claim 19 wherein said slurry of (a) comprises solids of a size ≤−320 mesh.

28. A method as in claim 19 wherein said feedstock is subjected to crushing and ball mill grinding operations in forming the slurry of (a).

29. A method as in claim 19 wherein said ultrasonic treatment includes the generation of micro-turbulence in said slurry.

30. A method as in claim 19 wherein said feedstock comprises one or more of the following ore forms: magnetite ($Fe_3O_4$), hematite ($Fe_2O_3$), geothite (FeO.OH), or siderite ($FeCO_3$).

31. A method as in claim 19 further comprising recovering and reusing process water.

32. A method as in claim 19 wherein (c) comprises a plurality of successive magnetic separations and the primary tail fraction of (c) is separated at a first magnetic separation and successive tail fractions are recycled to (b).

33. A method as in claim 19 wherein said concentrates are further filtered and dried to 90%-95% (weight) solids.

34. A method as in claim 19 wherein said concentrates contain at least 40% (weight) iron.

35. A method as in claim 19 wherein said slurry is screened prior to application of said ultrasonic treatment of (b).

36. A method as in claim 19 further comprising adding one or more amounts of water to said slurry.

37. A method as in claim 19 wherein said ultrasonic treatments include an ultrasonic intensity generally from about 100 watts/gallon to about 1000 watts/gallon for a selected residence time.

* * * * *